US009557088B2

(12) United States Patent
Bauriedl et al.

(10) Patent No.: US 9,557,088 B2
(45) **Date of Patent: *Jan. 31, 2017**

(54) ICE DISPENSING ARRANGEMENT

(71) Applicants: BSH HAUSGERAETE GMBH, Munich (DE); EMZ-HANAUER GMBH & CO. KGAA, Nabburg (DE)

(72) Inventors: Josef Bauriedl, Neunburg (DE); Albert Dirnberger, Neunburg (DE)

(73) Assignees: BSH Hausgeraete GmbH, Munich (DE); EMZ-Hanauer GmbH & Co. KGAA, Nabburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/653,307

(22) PCT Filed: Dec. 17, 2013

(86) PCT No.: PCT/EP2013/076864

§ 371 (c)(1),
(2) Date: Jun. 18, 2015

(87) PCT Pub. No.: WO2014/095832

PCT Pub. Date: Jun. 26, 2014

(65) Prior Publication Data

US 2015/0300718 A1 Oct. 22, 2015

(30) Foreign Application Priority Data

Dec. 18, 2012 (DE) ..... 10 2012 223 633

(51) Int. Cl.
*F25C 5/00* (2006.01)

(52) U.S. Cl.
CPC ..... *F25C 5/005* (2013.01)

(58) Field of Classification Search
CPC ..... F25C 5/002; F25C 5/005
See application file for complete search history.

(56) References Cited

U.S. PATENT DOCUMENTS 3,028,733 A * 4/1962 Mateski ..... F25C 1/04 62/135
3,889,888 A * 6/1975 Prada ..... F25C 5/005 241/101.1

(Continued)

FOREIGN PATENT DOCUMENTS

EP 1441189 A2 7/2004
EP 1517104 A1 3/2005

*Primary Examiner* — Frederick C Nicolas
*Assistant Examiner* — Bob Zadeh
(74) *Attorney, Agent, or Firm* — Laurence A. Greenberg; Werner H. Stemer; Ralph E. Locher

(57) ABSTRACT

An ice dispensing arrangement, particularly for a household refrigeration appliance, has a flap that is rotatable between a first and a second distribution position and a motor which actuates the flap via a transfer device. The transfer device has a rotational disk to be connected to a motor shaft, a piston rod and a rotating transfer element. The latter is rotatable a first and second position such that the flap in the first position of the rotating transfer element, is in the first distribution position and in the second position of the rotating transfer element, the flap is in the second distribution position. The rotating transfer element has a coupling element. The piston rod couples a motor shaft-eccentric point of the rotating disk to the coupling element of the rotating transfer element to rotate the transfer element between the first and second positions.

15 Claims, 6 Drawing Sheets

(56) References Cited

U.S. PATENT DOCUMENTS

| | | | | |
|---|---|---|---|---|
| 4,972,999 | A * | 11/1990 | Grace | F25C 5/046 241/101.1 |
| 5,267,672 | A * | 12/1993 | Jacobsen | A23G 9/045 198/716 |
| 5,273,219 | A | 12/1993 | Beach, Jr. et al. | |
| 6,880,355 | B2 | 4/2005 | Jung | |
| 7,040,111 | B2 | 5/2006 | Lee et al. | |
| 8,069,887 | B2 * | 12/2011 | Dirnberger | F25C 5/007 141/205 |
| 2005/0262866 | A1 | 12/2005 | Seo et al. | |
| 2010/0089492 | A1 * | 4/2010 | Dirnberger | F25C 5/007 141/351 |
| 2015/0300718 | A1 * | 10/2015 | Bauriedl | F25C 5/005 222/173 |
| 2015/0338147 | A1 * | 11/2015 | Bauriedl | F25C 5/046 49/324 |
| 2015/0354883 | A1 * | 12/2015 | Bauriedl | F25C 5/046 62/320 |

* cited by examiner

ICE DISPENSING ARRANGEMENT

BACKGROUND OF THE INVENTION

Field of the Invention

The invention relates to an ice dispensing arrangement, in particular for a household refrigeration appliance, which comprises a flap, which can be rotated between a first distribution position and a second distribution position, a transfer device and a motor, which actuates the flap via a transfer device.

Flaps are employed in the dispensing of ice from an ice storage container. This flap mechanism is frequently actuated via solenoids, wherein resetting of the flap is effected by springs. Alternatively, U.S. Pat. No. 6,880,355 B2 describes a cam disk solution, which actuates the flap for dispensing of ice from the ice storage container by means of a motor and a cam disk.

BRIEF SUMMARY OF THE INVENTION

It is the object of the invention to specify an improved ice dispensing arrangement and an improved household refrigeration appliance.

This problem is solved by means of the subject matter as claimed.

Advantageous embodiments of the ice dispensing arrangement are the subject of the dependent claims.

The invention relates to an ice dispensing arrangement, in particular for a household refrigeration appliance, which comprises a flap, which can be rotated between a first distribution position and a second distribution position, a transfer device and a motor, which actuates the flap via the transfer device. The transfer device has a rotating disk connected with the motor shaft, at least one piston rod and a rotating transfer element. The rotating transfer element is pivotable between a first position and a second position in such a way that in the first position of the rotating transfer element the flap takes up the first distribution position and in the second position of the rotating transfer element the flap takes up the second distribution position. The rotating transfer element is provided with a coupling element. The at least one piston rod couples a point on the rotating disk which is eccentric to the motor shaft with the coupling element of the rotating transfer element in such a way that the rotating transfer element can be rotated between the first position and the second position.

The term household refrigeration appliance should be understood to mean a refrigeration appliance, that is to say a refrigeration appliance used for housekeeping purposes in households or possibly also in the gastronomic field, and in particular serves to store foodstuffs and/or beverages in quantities customary within the household context, at specific temperatures, such as for example a refrigerator, an upright freezer, a fridge/freezer combination, a chest freezer or a wine storage cabinet.

In the case of refrigeration appliances, in particular household refrigeration appliances, a device for making ice-cubes or chunks of ice is often provided. To this end an ice-maker (a device for the preparation of chunks of ice or ice-cubes), an ice-crusher (a device for reducing the size of chunks of ice or ice-cubes) and a dispenser for removal of the ice-cubes are provided. The ice dispensing arrangement can be part of one or more of the aforementioned devices, can be used for a wide variety of the abovementioned refrigeration appliances and can also be designated an ice dispenser arrangement. In particular the ice dispensing arrangement serves to open and close a pivoting flap of an ice-crusher. The energy required to open and close the flap is provided by a motor, which is in particular an electric motor, wherein any type of suitable motor is conceivable.

The motor and the flap are coupled to each other via a transfer device, so that rotation of a motor shaft causes a movement of the flap. The flap can be moved between the first distribution position and the second distribution position. In this connection the term position can also be understood to mean a range of positions, that is to say the first and second distribution position can encompass several positions of the flap. In the first distribution position the flap of the ice-crusher is preferably positioned in such a way that in the first distribution position chunks of ice can be crushed. Here, the flap does not fully close the ice-crusher, so that the crushed chunks of ice can fall out of the ice-crusher. In the second distribution position of the flap, the ice-crusher is preferably opened wider, so that whole chunks of ice can fall through the ice-crusher without being crushed. The flap is preferably pivotable about a pivot axis.

The transfer device comprises the rotating transfer element, so that the flap and the motor can be located separately from each other. The rotating transfer element can be rotated at least between the first position and the second position, wherein the requisite energy is preferably provided by the motor. The first and second position can also be understood to mean a first range of positions and a second range of positions, wherein in particular the first and the second position or the first and second range of positions cover a range of angles.

In light of the embodiment with at least one piston rod the transfer device can in particular also comprise a crank drive, or be designated as such.

One end of the rotating transfer element, which is arranged in the vicinity of the motor, can preferably be coupled with the rotating disk via the at least one piston rod. The rotating disk is preferably fixed to the motor shaft in a torque-proof manner. The rotation of the rotating disk is preferably converted into a periodic movement of the coupling element by means of the piston rods. The highest point and the lowest point of the periodic movement correspond to the first and second position. The periodic movement can be a movement with a directional component in the vertical and/or a movement with a directional component in the horizontal direction.

It is preferable that the coupling element has a crank. The crank can also be designated as an offset.

It is further preferable that the crank comprises a connecting section and a crank section, wherein the connecting section connects the crank section with the rotating transfer element and the crank section operatively couples the rotating transfer element with the at least one piston rod.

It is preferable that the connecting section runs at an angle, preferably obliquely, to a longitudinal axis of the rotating transfer element and the crank section runs at least in sections parallel and offset to the longitudinal axis of the rotating transfer element. The connecting section and the crank section and/or the connecting section and the rotating transfer element can be embodied in one piece.

It is additionally preferable that the at least one piston rod is coupled in pivotable and/or displaceable form with the coupling element, in particular with the crank section.

The crank or offset as it is also known is connected with the rotating transfer element via the connecting section. The crank, the connecting section and the rotating transfer element are preferably embodied in one piece, and for example are manufactured from a metal or a plastic material. The piston rod can preferably rotate at least in part about the crank. This permits an up-and-down movement of the piston rods to generate a periodic movement of the crank, which in turn results in a rotation of the rotating transfer element. The rotation of the rotating transfer element takes place between the first position and the second position.

The motor shaft is preferably fixed at a central point of the rotating disk. The point at which the piston rod is arranged on the rotating disk is preferably offset relative to the central point and is thus eccentric. The piston rod and rotating disk can be manufactured from plastic or metal.

It is preferable that the transfer device has only one piston rod, which is operatively coupled with the crank section.

The piston rod is preferably coupled in a fixed position and pivotable with the crank section or the coupling element. The phrase 'in a fixed position' is in particular intended to mean that the crank section cannot move relative to the piston rod. 'Pivotable' is preferably intended to mean that the piston rod can be rotated relative to the crank or the crank section. It is thereby possible actively to rotate the transfer device from the first position to the second position and from the second position to the first position, that is to say to exert force upon the transfer device. This in turn means that the flap can be opened and closed when subject to force, or otherwise expressed, can be pivoted from the first distribution position into the second distribution position and vice versa. The piston rod is preferably fixed to the rotating disk in such a way that a 180°-rotation of the motor shaft rotates the transfer device from the first position into the second position and a further 180°-rotation of the motor shaft rotates the transfer device from the second position into the first position. This means that upon a rotation of the motor shaft, the flap is brought from the first distribution position into the second distribution position and back again. Alternatively the motor can be a bidirectional motor, so that the opening of the flap, rotation of the transfer device from the first position into the second position, takes place through rotation of the motor in the one direction, while the closure of the flap, rotation of the transfer device from the second position into the first position, takes place through rotation of the motor shaft in the opposite direction.

It is alternatively preferable that the transfer device has two or more piston rods, wherein each piston rod has an opening (also known as a transmission opening), into which the crank section projects and which is larger than the cross-sectional area of the crank section.

In the case of two piston rods, the transfer device is rotated from the first position into the second position preferably by means of a 90°-rotation of the motor shaft. A further 90°-rotation of the motor shaft turns the transfer device preferably from the second position into the first position, if two piston rods are provided. This means that upon one revolution of the motor shaft the flap is brought twice from the first distribution position into the second distribution position and back again. This preferably permits more rapid actuation of the flap.

It is further preferable that the at least one piston rod has one guide opening in each case, into which a guide element engages to guide the movement of the at least one piston rod.

The guide element is arranged in a fixed position relative to the motor, so that the piston rod and the guide element can move in opposition to each other. The guide element is preferably an axle or extends along an axle which is passed through the piston rod. By means of this arrangement the crank can be displaced relative to the axis of rotation of the rotating transfer element from the first position into the second position and upon further rotation of the motor shaft in the same direction, the contact between the crank and the piston rods is released, so that the rotating transfer element can rotate back into the first position once again. However no force is provided by the piston rods for the rotation of the rotating transfer element from the second position into the first position, so that a spring is preferably used to this end. The arrangement described here has the advantage that the flap can be opened multiple times during one revolution of the motor.

It is preferable that the rotating transfer element and the coupling element are embodied in one piece and/or that the rotating transfer element and the coupling element are in each case embodied as a bar element.

This represents a particularly simple embodiment of the transfer device, so that manufacturing costs can be saved.

It is preferable that the transfer device further has flap actuation device, wherein the rotating transfer element can be rotated between the first position and the second position, in order to pivot the flap between the first distribution position and the second distribution position by means of the flap actuation device, wherein the rotating transfer element is coupled with the flap actuation device in such a way that in the first position of the rotating transfer element the flap takes up the first distribution position and that in the second position of the rotating transfer element the flap takes up the second distribution position, and wherein a blocking device is provided to retain the flap in the first distribution position.

One end of the rotating transfer element, which is arranged close to the flap can preferably be provided with the flap actuation device, which can be embodied as a crank or lever arm. The flap actuation device can be embodied in one piece with the rotating transfer element. All possible types of fixing are conceivable for attachment of the flap actuation device to the rotating transfer element, wherein a one-piece embodiment of the flap actuation device and the rotating transfer element is preferable. Alternatively the flap actuation device can be fixed by means of screw attachment, gluing or welding.

The rotating transfer element is coupled with the flap actuation device in such a way that a rotation of the rotating transfer element results in a pivoting of the flap. In particular the flap is closed in the case of the first position of the rotating transfer element and open in the case of the second position of the rotating transfer element. Upon rotation from the first position of the rotating transfer element to the second position, the flap preferably moves from the first distribution position into the second distribution position. A rotation from the second position of the rotating transfer element into the first position can preferably effect a pivoting of the flap from the second distribution position into the first distribution position.

The blocking device holds the flap in the first distribution position. This can also be understood to mean a locking, closure or blocking of the flap. It can thus be achieved that the flap actuation device serves to open the flap, while the blocking device locks the flap. A firm locking of the flap is then particularly important if the pivoting flap is a flap of an ice-crusher, as during crushing of the ice, high forces are exerted on the flap. The blocking device is preferably coupled with the transmission rotation device, so that a rotation of the transmission rotation device brings about a movement of the blocking device. The blocking device can for example be a bar, which is arranged close to the flap and is moved by the transmission rotation device.

The flap, the blocking device and the rotating transfer element can be manufactured from a plastic or a metal.

Other materials which possess the requisite mechanical properties for the use of such parts are however conceivable.

It is preferable that the blocking device can be rotated between a blocking position for retention of the flap in the first distribution position and a release position.

In the blocking position of the blocking device, the blocking device blocks, holds or locks the flap. The flap can thus no longer open. In the release position the blocking device is pivoted relative to the blocking position, so that the pivoting of the flap is no longer prevented and the flap can be opened by means of the flap actuation device.

It is preferable that the blocking device, the rotating transfer element and/or the flap actuation device are pivotable about a common axis of rotation, which is preferably essentially parallel to the pivot axis of the flap.

The common axis of rotation is preferably an axis of rotation of the rotating transfer element. This represents a simple embodiment. If the pivot axis of the flap and the axis of rotation of the rotating transfer element are parallel to each other, the motor can be arranged in front of or behind the flap, for example behind the ice-maker and/or the ice-crusher. This permits a variable arrangement of the individual components, so that particularly good use can be made of the available space in a refrigeration appliance.

It is further preferable that the blocking device is arranged on the flap actuation device and/or on the rotating transfer element.

A particularly simple pivoting of the blocking device can thereby be achieved, wherein the blocking device and the flap actuation device rotate synchronously. This ensures in particular that the flap can only be opened when it is not locked. The blocking device can be embodied in one piece with the flap actuation device. The blocking device is preferably fixed to the flap actuation device, in particular by means of a snap fastener or a clamping device. The blocking device rotates with the flap actuation device. In the same way, the blocking device can be arranged on the rotating transfer element. In this way the blocking device can also be attached both to the flap actuation device and to the rotating transfer element.

If the blocking device is arranged close to the rotating transfer element or to be more precise close to the axis of rotation of the rotating transfer element, a lower torque is exerted on the rotating transfer element upon unlocking of the flap than if the blocking device is arranged further away from the axis of rotation of the rotating transfer element on the flap actuation device. It is thereby possible that in the case of constant torque on the rotating transfer element in the first position a greater retention force can be exerted on the flap, as greater frictional forces can operate in the blocking device as a result of the lesser leverage. Accordingly, greater forces can operate on the flap in the ice-crusher.

It is additionally preferable that a projection is arranged on the flap and the blocking device has a stop to keep the flap in the first distribution position, wherein the stop blocks the projection only in the first position to keep the flap in the first distribution position.

A projection is arranged on the flap, which can be embodied in one piece with the flap or can be fixed to the flap. To affix the projection to the flap, a very wide variety of methods are conceivable, such as in particular gluing, screwed connection, welding or the like. In the first position the projection and the blocking device preferably engage with each other, so that the flap is thereby locked or held.

The stop of the blocking device preferably engages behind the projection of the flap. This represents a secure and simple blocking device. The form of the stop is preferably matched to the form of the projection and in particular the projection engages behind the stop in a form-fitted manner.

It is preferable that the flap or the projection have an accommodating area, which is bounded by a peripheral border, which stands proud of the accommodating area. The flap actuation device further preferably has an arm which projects into the accommodating area.

Accordingly the flap is pivoted into the second distribution position by the flap actuation device, when the rotating transfer element rotates about its axis of rotation. To this end the flap has an accommodating area, which is bounded by a circumferential edge. The circumferential edge stands proud of the accommodating area in such a way that when the flap actuation device moves, the flap actuation device moves against the circumferential edge. The accommodating area can in particular be a surface preferably projecting vertically from the circumferential edge. The accommodating area can however also be a cavity, which is bounded by the circumferential edge. In this case too, the circumferential edge stands proud of the accommodating area. An arm of the flap actuation device stands in the accommodating area. The arm is preferably curved, and a part of the arm is parallel to the axis of rotation of the rotating transfer element.

Advantageously, the opening of the flap can thus be functionally separated from the locking of the flap by means of the blocking device. As the arm is preferably further removed from the axis of rotation of the rotating transfer element than the blocking device, the arm describes a longer arc sector, so that the arm can open the flap wide. By comparison, upon movement of the flap actuation device the blocking device describes a shorter arc sector, so that the blocking device, if it were to open the flap, could not open the flap as wide. Conversely, with a constant motor power, the arm can exert a lower force than the blocking device, as the arm is at a greater distance from the axis of rotation of the rotating transfer element than the blocking device. For unlocking of the flap and thus also its blocking, a greater force is however generally required compared to the opening of the flap. The requirements for the unlocking and opening of the flap are advantageously met in a simple manner through the functional separation by means of the arm and the blocking device.

Closure of the flap can be achieved either by means of the flap actuation device, in particular by means of the arm, or also by means of a spring, which pushes the flap into the first distribution position, which corresponds to the first position of the rotating transfer element. The locking then takes place by means of the blocking device.

It is preferable that in the case of location of the rotating transfer element in the first position the arm does not touch the circumferential edge and, with the location of the rotating transfer element in the second position, the arm preferably presses against the circumferential edge.

In the first position, that is when the flap is in the first distribution position, the arm does not touch the edge region or exerts no force. If a force now operates on the flap, jams between the arm and the circumferential edge of the flap cannot occur, so that it is less likely for opening of the flap to be blocked. This can in particular arise in the prior art, as there the opening and locking of the flap takes place by means of the flap actuation device, so that upon locking, the flap actuation device and the flap frequently jam, and opening of the flap is then blocked. The distance between the circumferential edge and the arm is preferably selected such that the incidence of jams is minimized, although the distance is not too great, so that a reduction of the opening angle of the flap achieved through the flap actuation device is avoided. The flap is then opened when the arm of the flap actuation device presses against the circumferential edge. The second position is thus the range for which the flap is opened or is open.

It is further preferable that the rotating transfer element and the flap actuation device are in each case embodied as a bar element and/or that the rotating transfer element and the flap actuation device are embodied in one piece.

This represents an embodiment of the rotating transfer element and the flap actuation device which is particularly simple to manufacture. Production costs can thus be reduced.

It is preferable that the rotating transfer element and/or the arm extends essentially parallel to the pivot axis of the flap. It is further preferable that the flap actuation device essentially extends radially to the pivot axis of the flap and/or essentially vertically from the rotating transfer element.

The invention further provides a refrigeration appliance, in particular a household refrigeration appliance, which comprises an ice dispensing arrangement, as described above. Accordingly, the refrigeration appliance possesses an ice dispensing arrangement with the features and advantages described above. Furthermore, the refrigeration appliance, in particular the household refrigeration appliance, can comprise an ice-crusher (device for crushing chunks of ice) and/or an ice-maker (device for forming chunks of ice).

By way of summing up and alternatively a preferred embodiment of the invention is to be described here once again.

Through the use of a crank drive as a component of the transfer device with a crank the flap can be forcibly moved both in the direction of opening and in the direction of closure by the motor. This crank drive can preferably be connected with the flap by means of a connecting bar as the rotating transfer element, wherein this connecting bar is preferably angled at both ends. The crank drive can be generated by means of one or more piston rods. The use of multiple piston rods has the advantage, among others, that in the case of a slowly running motor, the flap can be opened and closed in a short time.

A further improvement has been arranged on the flap side. As already explained above, the connecting bar has an offset, both on the crank side and on the flap side, in order to actuate the flap. On the flap side the crank can be used to block the flap for crushing of the ice and then, when the crank drive is activated, to open the flap by means of a lever. If the flap is opened, the ice-cubes are dispensed whole, without being crushed. During crushing, however, it can happen that the fragments of ice-cube exert a great force on the flap as a result of jamming in the crusher-housing. As a result of the high frictional force which now arises between the connecting bar and the flap, the motor requires a high level of power to open the flap. The crank can preferably have a certain length, so that the flap can be opened wide enough with the crank drive. Through the possible separation of the functions—blocking and opening—the flap can be securely unlocked and simultaneously opened wide by means of a less powerful motor. The blocking edge for the flap is located close to the pivot point of the connecting bar, and more force for unlocking of the flap is thus made available by the lever drive. The long lever arm can only be used to open the flap. The advantage of the invention described here compared with the magnetic solution described in the introduction, in which the flap is opened in a jerky manner, is further a slow distribution of the ice-cubes from the ice supply container. In particular through the use of a crank drive with a crank, the flap can be forcibly moved by the motor both in the direction of opening as well as in the direction of closure. The crank drive is connected with the flap by means of the connecting bar, which is angled at both ends. Secure opening and closing of the flap is thereby guaranteed. The flap can further be securely unlocked and simultaneously opened sufficiently wide by means of a less powerful motor through the separation of the blocking and opening functions.

BRIEF DESCRIPTION OF THE SEVERAL VIEWS OF THE DRAWING

Embodiments and advantages of the invention will now be presented on the basis of the exemplary embodiment shown in the drawings. Wherein.

DESCRIPTION OF THE INVENTION

Figure 1:
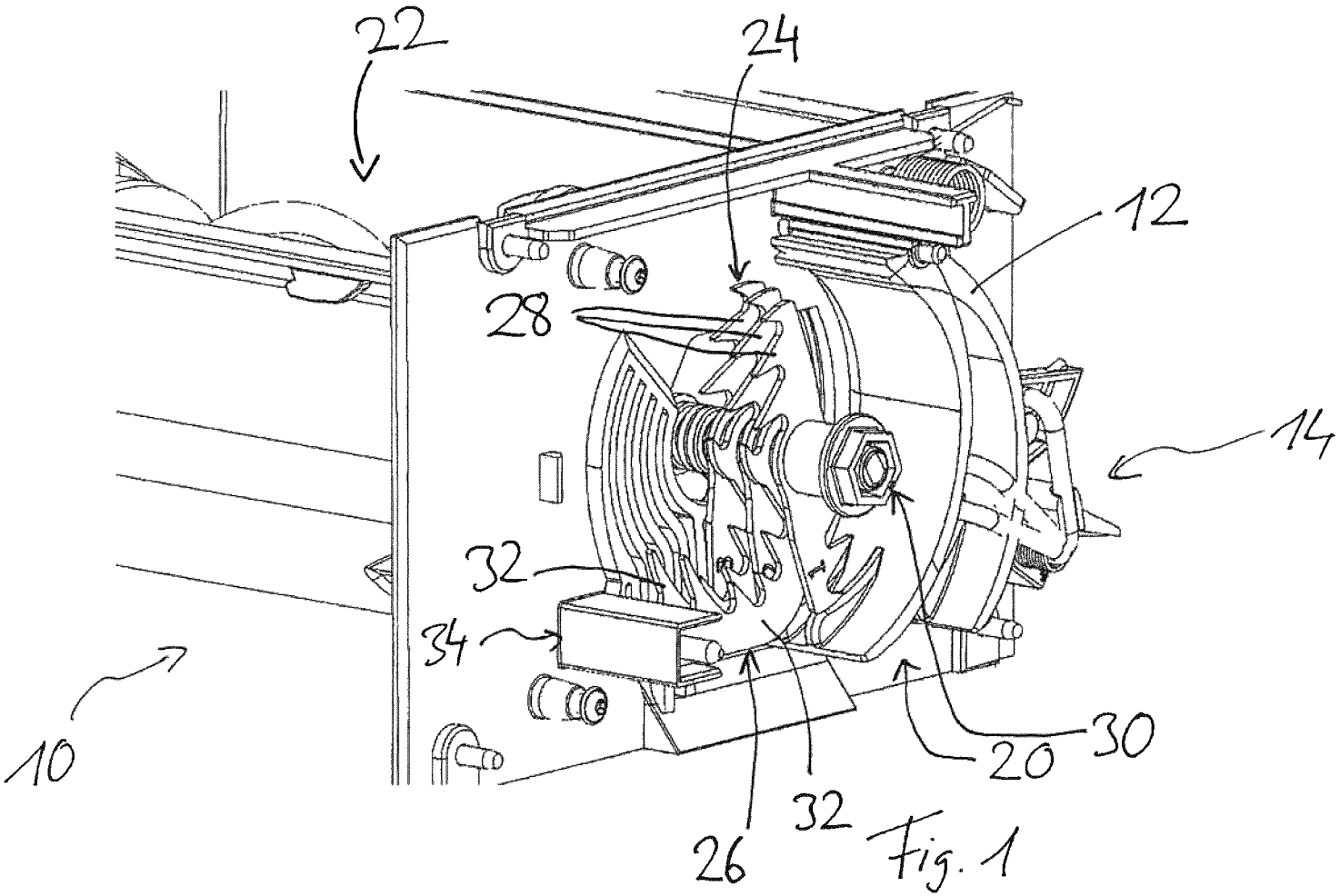
FIG. 1 shows a three-dimensional view of an ice dispensing arrangement in three positions.
Figure 2:
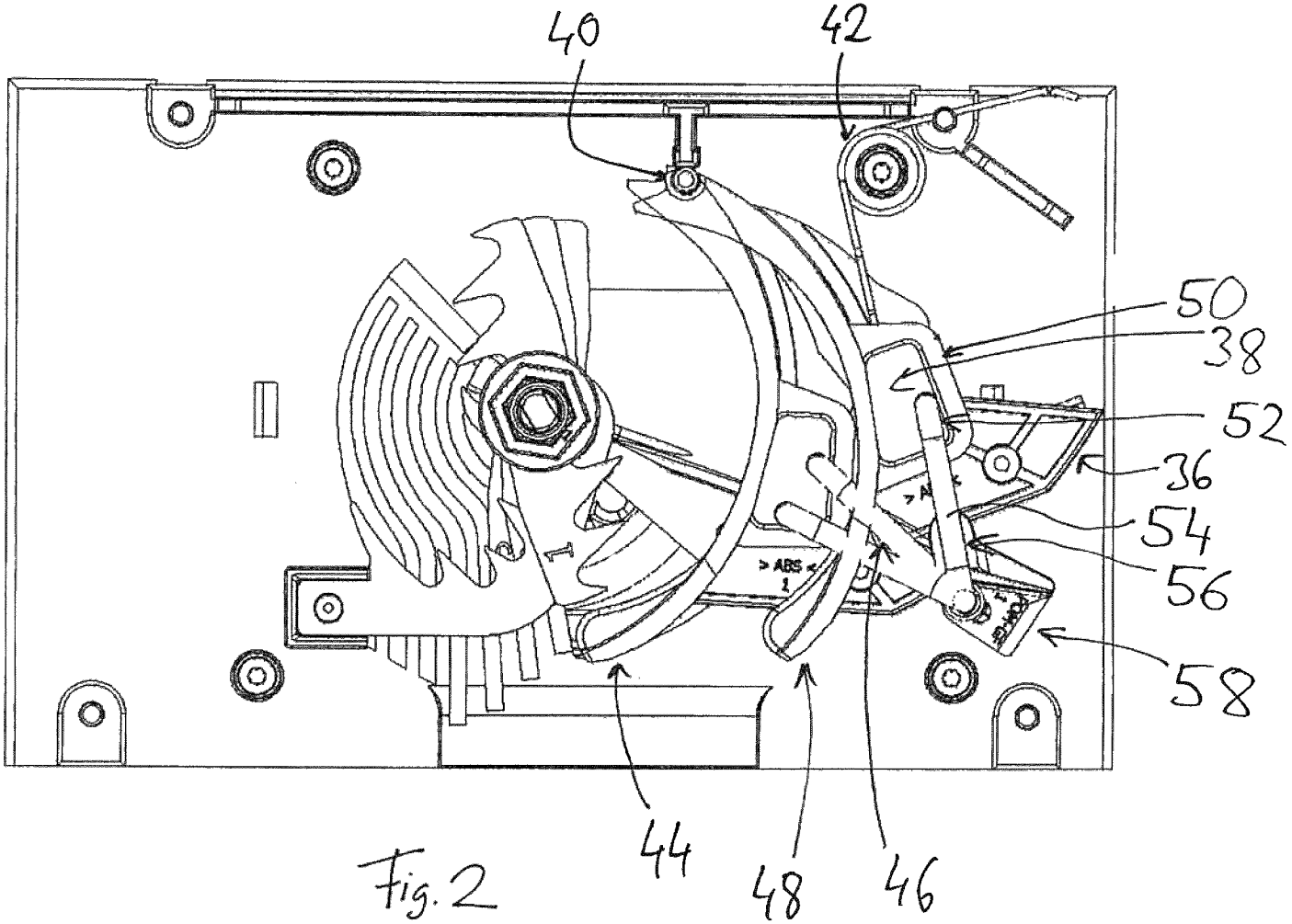
FIG. 2 shows a plan view of the ice dispensing arrangement in three positions.
Figure 3B:
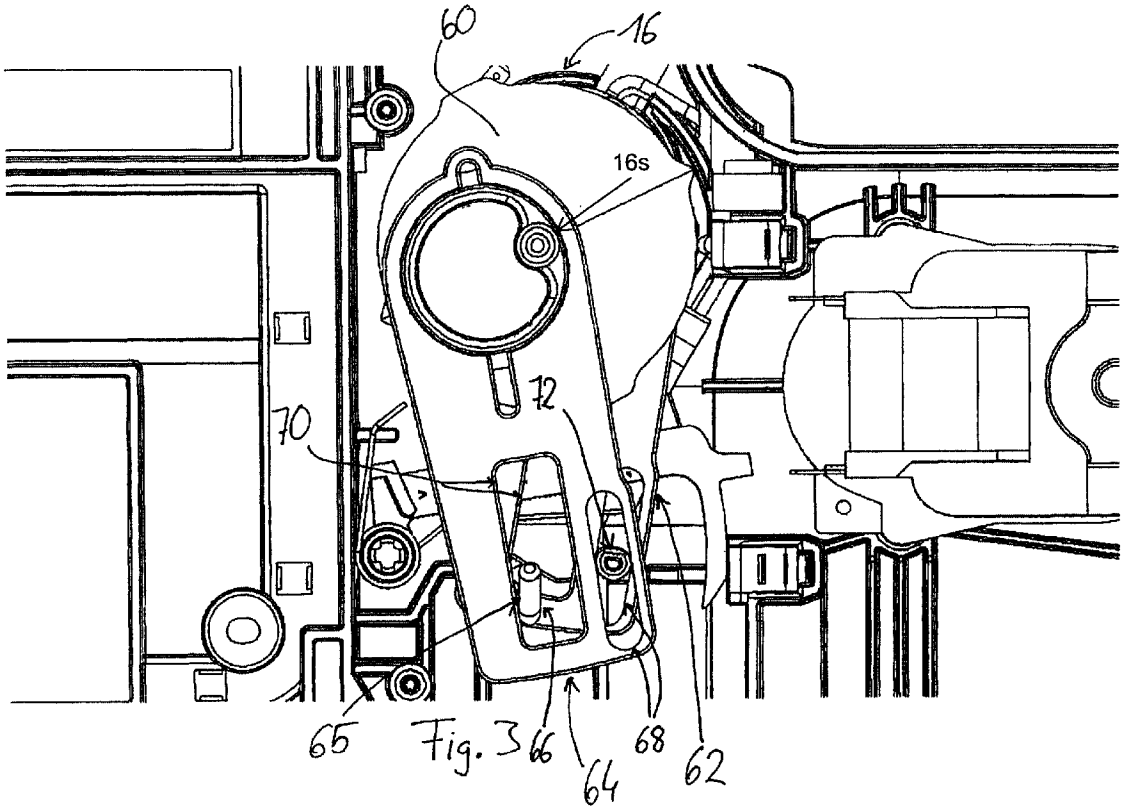
FIG. 3 shows a plan view of the ice dispensing arrangement from the motor side.
Figure 4:
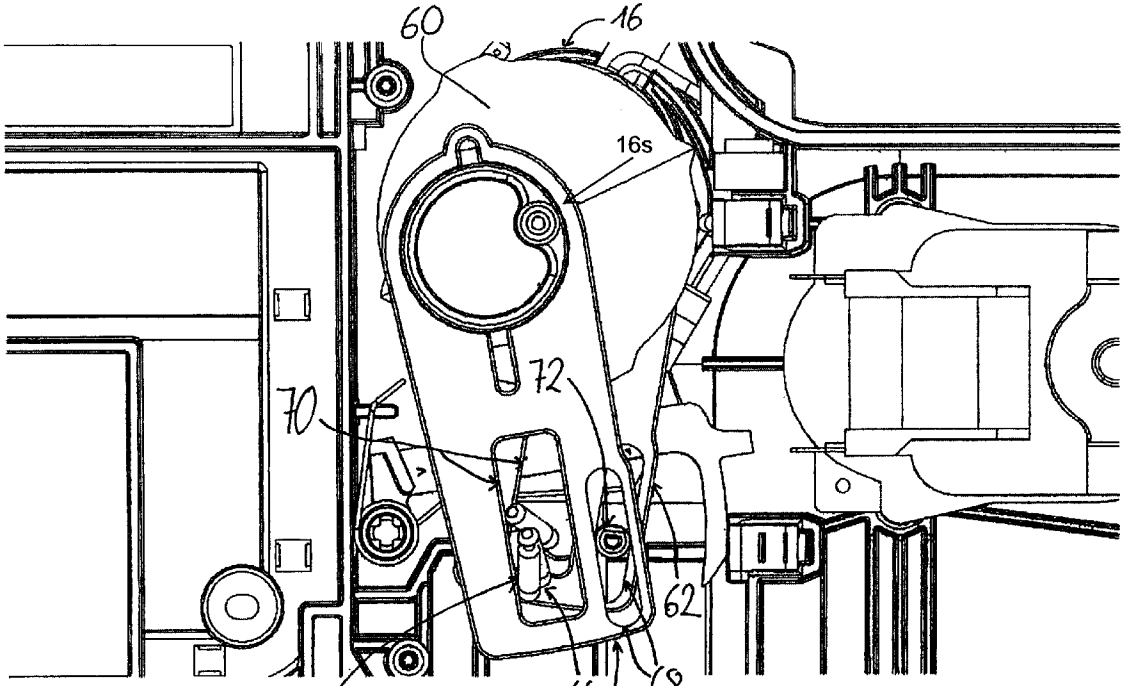
FIG. 4 shows a plan view from the motor side of the ice dispensing arrangement in three positions.
Figure 5:
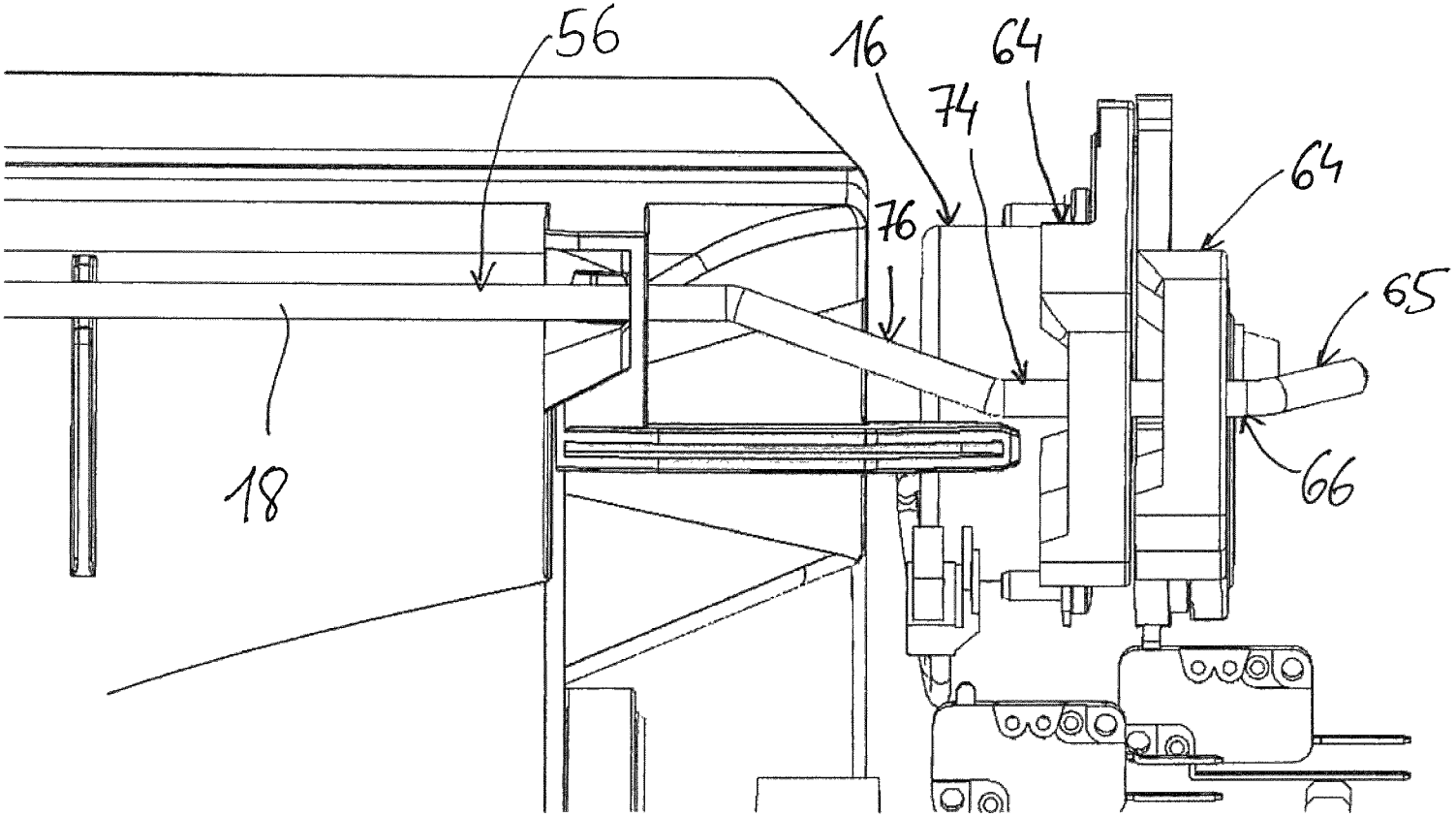
FIG. 5 shows a view from beneath the ice dispensing arrangement on the motor side.
Figure 6:
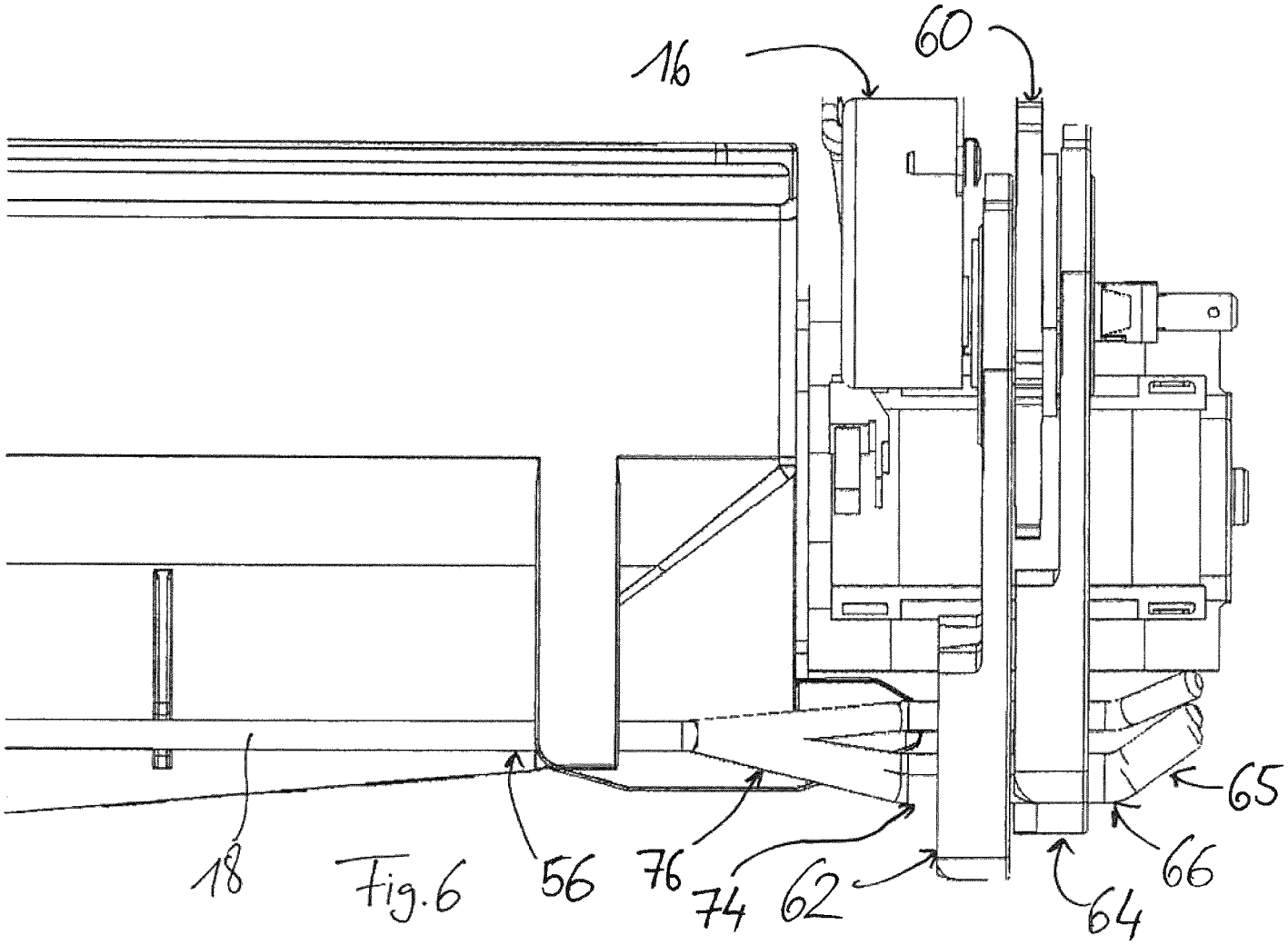
FIG. 6 shows a plan view from beneath the ice dispensing arrangement in three positions from the motor side.

An ice dispensing arrangement 10 has a flap 12, a motor 16 and a transfer device 14. FIGS. 1 and 2 show the flap-side part of the transfer device 14. In FIG. 3 through 6 the motor 16 and the motor-side part of the transfer device 14 are shown. The transfer device 14 has a bar element 18, which is shown in FIGS. 5 and 6, which connects the motor-side part of the transfer device 14 with the flap-side part of the transfer device 14. The motor 16 actuates the transfer device 14 in such a way that the bar element 18 rotates about its axis of rotation between a first position and a second position. The flap 12 is pivoted by means of the rotation of the bar element 18.

Initially the flap side of the ice dispensing arrangement 10 will be described with reference to FIGS. 1 and 2. The flap 12 of the ice dispensing arrangement 10 is a flap 12 of an ice-crusher 20, which can be pivoted between a first distribution position 44 and a second distribution position 48. The ice-crusher 20 is arranged on an ice distributor 22. The ice distributor 22 can have an ice-maker. The ice-crusher 20 has a fixed housing part (not shown) and the flap 12, which form a housing of the ice-crusher 20. Arranged in the housing are a movable set of blades 24 and a fixed set of blades 26. The movable set of blades 24 preferably has three movable blades 28, which are attached to a rotating shaft 30 of the ice-crusher 20. Through the rotation of the rotating shaft 30 by means of a motor (not shown), the movable blades 28 are moved towards the fixed set of blades 26. Chunks of ice provided by the ice distributor 22 are crushed between the fixed set of blades 26 and the movable set of blades 24. The fixed set of blades 26 preferably has two fixed blades 32, which are fixed to a retention device 34 of the ice-crusher. The fixed blades 32 are not movable.

The flap 12 has a projection 36 and an accommodating area 38. The flap 12 is mounted in pivotable form about a pivot axis 40 and pressed into a first distribution position 44 via a spring 42. In the first distribution position 44 the ice-crusher 20 is closed to the extent that chunks of ice in can be crushed in the ice-crusher 20. Crushed chunks of ice can fall out of the ice-crusher 20 in the first distribution position. In an alternative embodiment the spring 42 can be dispensed with, and the opening and closing of the flap 12 effected by means of the flap actuation device.

In the first distribution position 44 the projection 36 protrudes from the flap 12 in the direction of the bar element 18. The flap 12 can be pivoted into the second distribution position 48 via a transitional position 46. The first distribution position 44 can be a range, while the transitional position 46 separates the first distribution position 44 from the second distribution position 48, which can also be a range. The aforementioned range can in particular be understood as a range of angles.

The accommodating area 38 is bounded by the circumferential edge 50. The circumferential edge 50 stands proud of the accommodating area 38. The height of the circumferential edge 50, that is the length of the protrusion of the circumferential edge 50 relative to the accommodating area 38, is such that an arm 52 of a flap actuation device 54 of the bar element 18 can transmit force for opening and/or closure of the flap 12.

The bar element 18, the flap actuation device 54 and the arm 52 form one part of a rotating transfer element 56. The bar element 18 can be a hollow or solid bar. In the embodiment shown the bar element 18, the flap actuation device 54 and the arm 52 are manufactured in one piece from a material, such as for example plastic or metal. The arm 52 can essentially be embodied in L-shaped, C-shaped, partially straight or curved form.

A blocking device 58 is attached to the flap actuation device 54. The blocking device 58 has a stop (not shown) and abuts the bar element 18. The blocking device 58 is for example fixed to the flap actuation device 54 via a clamping mechanism. In the first distribution position 44 of the flap 12 the stop of the blocking device 58 engages behind an end area, preferably a pointed end, of the projection 36. Here, the rotating transfer element 56 or the bar element 18 takes up a first position. If the stop and the projection 36 are not in engagement with each other, as for example in the second distribution position 48 of the flap 12, the rotating transfer element 56 or the bar element 18 are located in a second position. The position of the blocking device 58, in which the stop and the projection 36 engage with each other, is designated the blocking position and correlates with the first distribution position 44 of the flap 12 and the first position of the rotating transfer element. The position of the blocking device 58, in which the stop and the projection 36 are not in engagement with each other, is designated the release position, and correlates with the second distribution position 48 of the flap 12 and the second position of the rotating transfer element.

The pivot axis 40 of the flap 12 is parallel to the axis of rotation of the rotating transfer element 56. Further, that part of the arm 52, which projects into the accommodating area 38, is parallel to the pivot axis 40 and to the axis of rotation of the rotating transfer element 56. The blocking device 58, the arm 52 and the flap actuation device 54 can be rotated about the axis of rotation of the rotating transfer element 56.

The method of functioning for opening of the flap 12 is now to be described below.

In the first distribution position 44 the bar element 18 is in the first position and the blocking device 58 engages behind or blocks the projection 36 in the blocking position. The flap 12 is thereby blocked by means of the blocking device 58, while the arm 52 of the flap actuation device 54 does not touch the circumferential edge 50. If the bar element 18 is now moved in the direction of the second position, the transitional position 46 is assumed at this point in time. In the transitional position 46 the blocking device 58 no longer engages behind or blocks the projection 36, and the blocking device 58 takes up the release position. The arm 52 of the flap actuation device 54 now touches the circumferential edge 50 of the accommodating area 38. With a further movement of the bar element 18 in the direction of the second position, the arm 52 of the flap actuation device 54 presses against the circumferential edge 50 of the accommodating area 38 and the flap 12 is opened against the pretensioning of the spring 42, until the flap 12 reaches the second distribution position 48. The arm 52 of the flap actuation device 54 engages with the flap 12 at a greater distance from the axis of rotation of the bar element 18 than the blocking device 58. A lesser force is thus exerted on the flap 12 by the arm 52, with the same torque on the bar element 18, than by the blocking device 58. With the same torque on the bar element 18 a greater unlocking force for unlocking the flap 12 than opening force can thereby be achieved. A greater force can thus operate on the flap 12 in the ice-crusher 20 too.

Upon rotation of the bar element 18 from the second position into the first position the flap 12 is pressed into the first distribution position 44 by means of the pretensioning of the spring 42. The blocking device 58 now once again engages behind or blocks the projection 36 and the flap 12 is locked (blocking position of the blocking device 58).

The motor-side part of the transfer device 14 is now to be described in the subsequent text.

On the motor side the transfer device 14 has a rotating disk 60, a first piston rod or connecting rod 62 and a second piston rod or connecting rod 64. The transfer device 14 on the motor-side end of the bar element 18, which corresponds to the second end, further has a coupling element 65, which in the embodiment shown is or comprises a crank 66.

The rotating disk 60 is fixed centrally on a motor shaft 16*s*. The first piston rod 62 is arranged in closer proximity to the motor 16 on one side of the rotating disk 60, while the second piston rod 64 is arranged further away from the motor 16 on the other side of the rotating disk 60. Both piston rods 62, 64 are fixed eccentrically to the motor shaft in pivotable form. Upon a rotation of the motor shaft and an associated rotation of the rotating disk 60, the piston rods 62 and 64 are moved up and down. The piston rods 62, 64 further have a guide opening 68 and an opening or transmission opening 70. A guide element 72 in the form of a guide axis is arranged in both guide openings 68. The guide openings 68 have a greater length than width, wherein the width of the guide openings 68 corresponds to a diameter of the guide element 72. Upon the up-and-down movement of the piston rods 62, 64 the guide opening 68 moves along the guide element 72. The crank 66 of the bar element 18 protrudes into the two transmission openings 70 of the piston rods 62, 64. In particular a crank section 74 of the crank 66 is arranged in the two transmission openings 70 of the piston rods 62, 64 or protrudes into these. The transmission opening 70 is larger than the guide opening 68.

As may in particular be seen in FIGS. 5 and 6, the crank 66 comprises the crank section 74 and a connecting section 76. The connecting section 76 is inclined against the bar element 18 and the crank section 74 and connects these. A longitudinal axis of the crank section 74 is offset parallel to the axis of rotation of the bar element 18. The bar element 18 is mounted in pivotable form.

The method of functioning of the motor-side transfer device 14 is now to be described in the subsequent text.

Upon actuation of the motor 16 the motor shaft 16 is rotated and thus also the rotating disk 60. Through the eccentric arrangement of the piston rods 62, 64, these are moved up and down. Because of the guide element 72, the crank 66 is deflected sideways in relation to the axis of rotation of the bar 18. In FIG. 4 the crank 66, or to be more precise the crank section 74, is deflected to the right. The deflection takes place solely by means of one of the piston rods 62, 64. In the case of a further rotation of the rotating disk 60 or the motor shaft, the piston rods 62, 64 are so positioned that they effect no deflection of the crank 66. Through the pretensioning of the spring 62, the flap 12 is pressed back into its first distribution position, and the crank 66 can once again move into the first position shown in FIG. 3. If the rotating disk 60 rotates still further, the crank 66 is deflected by the other piston rod 62, 64. In the case of renewed further rotation of the rotating disk 60 in the same direction, the crank 66 loses contact with the other one of the two piston rods 62, 64 and the piston rod 62, 64 once again moves back into the first position shown in FIG. 3.

LIST OF REFERENCE CHARACTERS

10 Ice dispensing arrangement
12 Flap
14 Transfer device
16 Motor
18 Bar element
20 Ice-crusher
22 Ice distributor
24 Moveable set of blades
26 Fixed set of blades
28 Moveable blade
32 Fixed blade
34 Retention device
36 Projection
38 Accommodating area
40 Pivot axis
42 Spring
44 First distribution position
46 Transitional position
48 Opening position
50 Circumferential edge
52 Arm
54 Flap actuation device
56 Rotating transfer element
58 Blocking device
60 Hub
62 First piston rod
64 Second piston rod
65 Coupling element
66 Crank
68 Guide opening
70 Transmission opening
72 Guide element
74 Crank section
76 Connecting section

The invention claimed is:

1. An ice dispensing arrangement, comprising:

a flap mounted for rotation between a first distribution position and a second distribution position;

a transfer device; and a motor configured to actuate said flap via said transfer device, said motor including a motor shaft;

said transfer device including a rotating disk connected to said motor shaft, at least one connecting rod, and a rotating transfer element;

said rotating transfer element being rotatable between a first position and a second position wherein, with said rotating transfer element in the first position, said flap assumes the first distribution position and with said rotating transfer element in the second position, said flap assumes the second distribution position;

said rotating transfer element being provided with a coupling element; and said at least one connecting rod coupling a point on said rotating disk that is eccentric to said motor shaft with said coupling element of said rotating transfer element, enabling a rotation of said rotating transfer element between the first position and the second position.

2. The ice dispensing arrangement according to claim 1 configured for a household refrigeration appliance.

3. The ice dispensing arrangement according to claim 2, wherein said crank includes a connecting section and a crank section, wherein said connecting section connects said crank section with said rotating transfer element and said crank section operatively couples said rotating transfer element with said at least one connecting rod.

4. The ice dispensing arrangement according to claim 3, wherein said connecting section runs at an angle to a longitudinal axis of said rotating transfer element and said crank section runs at least in sections offset in parallel to the longitudinal axis of said rotating transfer element.

5. The ice dispensing arrangement according to claim 4, wherein said connecting section runs obliquely to the longitudinal axis of said rotating transfer element.

6. The ice dispensing arrangement according to claim 3, wherein said at least one connecting rod of said transfer device is a single connecting rod, which is operatively coupled with the crank section.

7. The ice dispensing arrangement according to claim 3, wherein said at least one connecting rod of said transfer device is one of two or more connecting rods, and wherein each said connecting rod is formed with an opening, into which said crank section projects and which is larger than a cross-sectional area of said crank section.

8. The ice dispensing arrangement according to claim 1, wherein said coupling element has a crank.

9. The ice dispensing arrangement according to claim 1, wherein said at least one connecting rod is pivotally and/or displaceably coupled with said coupling element.

10. The ice dispensing arrangement according to claim 9, wherein said at least one connecting rod is pivotally and/or displaceably coupled with said crank section.

11. The ice dispensing arrangement according to claim 1, wherein said at least one connecting rod is formed with a guide opening, and wherein a guide element engages in said guide opening to guide a movement of said at least one connecting rod.

12. The ice dispensing arrangement according to claim 1, wherein said rotating transfer element and said coupling element are embodied in one piece and/or each said rotating transfer element and said coupling element are embodied as a bar element.

13. The ice dispensing arrangement according to claim 1, wherein:

said transfer device further has a flap actuation device configured to rotate said rotating transfer element between the first position and the second position, in order to pivot said flap between the first distribution position and the second distribution position;

said rotating transfer element is coupled with said flap actuation device in such a way that in the first position of said rotating transfer element said flap assumes the first distribution position and in the second position of said rotating transfer element said flap assumes the second distribution position; and a blocking device is provided to hold said flap in the first distribution position.

14. A refrigeration appliance, comprising an ice dispensing arrangement according to claim 1.

15. A household refrigerator, comprising an ice dispensing arrangement according to claim 1.

* * * * *